US008732901B2

(12) United States Patent
Shim et al.

(10) Patent No.: US 8,732,901 B2
(45) Date of Patent: May 27, 2014

(54) ROBOT CLEANER

(75) Inventors: In-Bo Shim, Changwon-si (KR); Sung-Guen Kim, Changwon-si (KR); Byung-Doo Yim, Changwon-si (KR); Bong-Ju Kim, Changwon-si (KR); Ji-Hoon Sung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 278 days.

(21) Appl. No.: 13/263,002

(22) PCT Filed: Jul. 6, 2009

(86) PCT No.: PCT/KR2009/003674

§ 371 (c)(1),
(2), (4) Date: Oct. 5, 2011

(87) PCT Pub. No.: WO2011/004915

PCT Pub. Date: Jan. 13, 2011

(65) Prior Publication Data

US 2012/0023699 A1 Feb. 2, 2012

(51) Int. Cl.
*A47L 9/10* (2006.01)

(52) U.S. Cl.
USPC ..... 15/347; 15/339; 15/352; 15/340.1

(58) Field of Classification Search
USPC ..... 15/319, 339, 340.1, 352, 353, 347
IPC ..... A47L 9/10
See application file for complete search history.

(56) References Cited

FOREIGN PATENT DOCUMENTS

| | | | |
|---|---|---|---|
| KR | 10-2000-0041557 | A | 7/2000 |
| KR | 10-2005-0012116 | A | 1/2005 |
| KR | 10-2006-0107624 | A | 10/2006 |
| KR | 10-2006-0115220 | A | 11/2006 |
| KR | 10-2007-0018641 | A | 2/2007 |

*Primary Examiner* — David Redding
(74) *Attorney, Agent, or Firm* — KED & Associates, LLP

(57) ABSTRACT

Provided is a robot cleaner, and more particularly to a robot cleaner for shielding particularly an air inlet of a foreign material storage unit. The robot cleaner includes a main body including a drive unit for providing a suction force, a main cover for shielding a side of the main body, a foreign material storage unit separably disposed on the main cover, the foreign material storage unit having an air inlet for introducing air containing foreign materials, a foreign material cover disposed on the main cover, the foreign material cover selectively shielding a side of the foreign material storage unit, and a shield member disposed on the foreign material storage unit, the shield member selectively shielding the air inlet.

11 Claims, 11 Drawing Sheets

ROBOT CLEANER

BACKGROUND

Embodiments relate to a robot cleaner which perform cleaning while moving by oneself.

In general, cleaners are devices that suck air containing dusts using a suction force generated by a suction motor mounted in a main body thereof to filter the dusts within the main body. Such a cleaner may be classified into a manual cleaner that is directly manipulated by a user and a robot cleaner that performs cleaning for oneself without being manipulated by the user.

A general robot cleaner uses a charged battery as a power source. The robot cleaner performs cleaning for oneself while moving along a bottom of an area to be cleaned according to an inputted program. Thus, the robot cleaner is being developed and used into various types in line with needs of modern man which pursues reduced cleaning time and convenience.

The robot cleaner includes a main body defining an outer appearance thereof and a duct container disposed inside the main body. Air sucked into the robot cleaner may be sucked into the duct container via a predetermined path. Here, the dusts may be filtered while passing through the duct container. Then, when the duct container is filled with some dusts, the user may empty the dust container to perform the cleaning.

In the robot cleaner according to a related art, there is a limitation that dusts stored within the duct container may be discharged in a path direction, i.e., may flow backward. Also, when the user empties the dust container, the dusts may be discharged into the outside to cause unsanitary environment.

Also, when the inside of the dust container is clogged with the dusts, the suction force of the suction motor may not be well transmitted into a surface to be cleaned (hereinafter, referred to as a cleaning surface) to reduce suction performance of the cleaner.

SUMMARY

Embodiments provide a robot cleaner in which a foreign material storage unit is selectively opened according to whether the cleaner is operated.

Embodiments also provide a robot cleaner in which blocking of a foreign material storage unit is detected.

Embodiments also provide a robot cleaner in which a foreign material storage unit is easily separated.

In one embodiment, a robot cleaner includes: a main body including a drive unit for providing a suction force; a main cover for shielding a side of the main body; a foreign material storage unit separably disposed on the main cover, the foreign material storage unit having an air inlet for introducing air containing foreign materials; a foreign material cover disposed on the main cover, the foreign material cover selectively shielding a side of the foreign material storage unit; and a shield member disposed on the foreign material storage unit, the shield member selectively shielding the air inlet.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
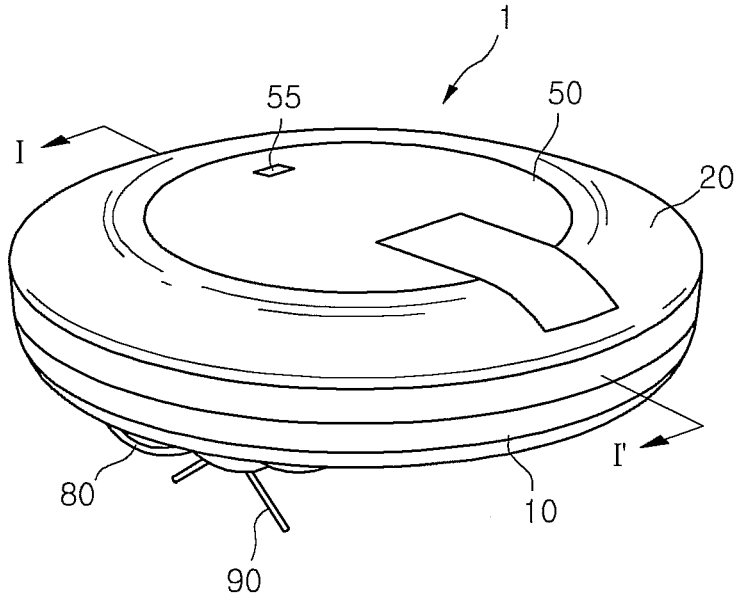
FIG. 1 is a perspective view of a robot cleaner according to a first embodiment.
Figure 2:
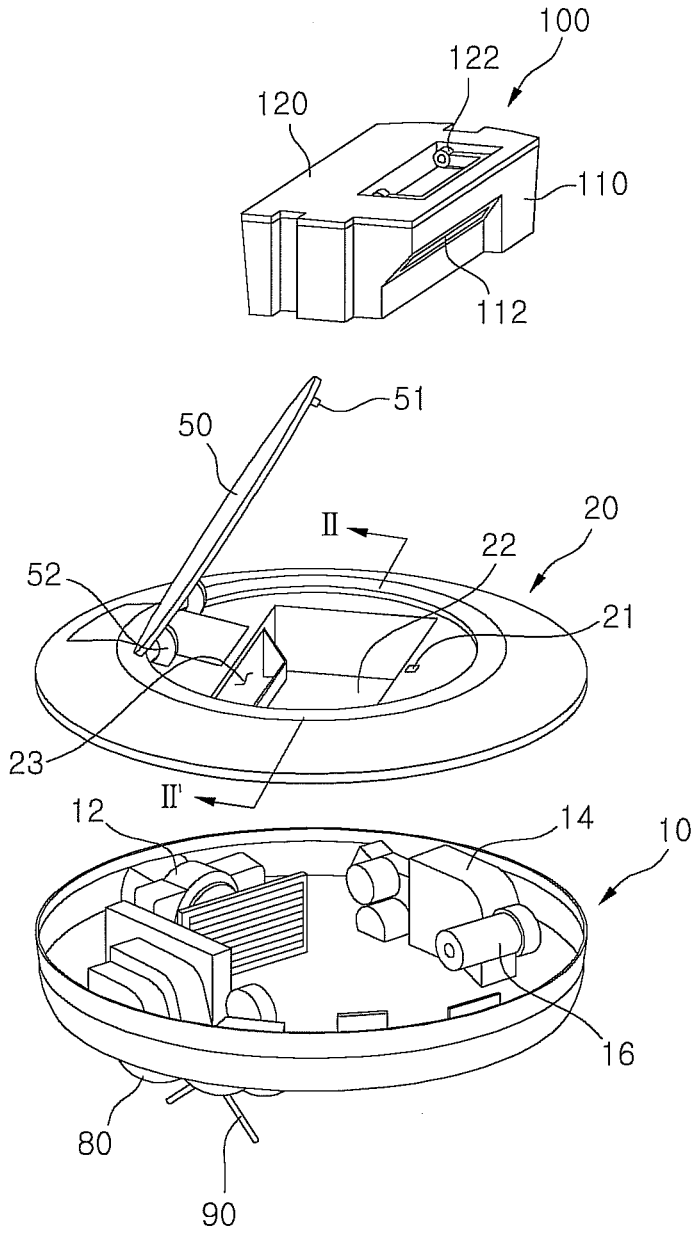
FIG. 2 is an exploded perspective view of the robot cleaner according to the first embodiment.

FIG. 1 is a perspective view of a robot cleaner according to a first embodiment. FIG. 2 is a perspective view of a robot cleaner according to a first embodiment.

Referring to FIGS. 1 and 2, a robot cleaner 1 according to a first embodiment includes a main body 10 defining an outer appearance thereof, a first cover 20 covering an upper portion of the main body 10, a second cover 50 disposed on the first cover 20 to selectively shield a portion of an opened top surface of the first cover 20, and a foreign material storage unit 100 storing foreign materials contained in air sucked therein.

A moving wheel 80 for easily moving the robot cleaner is disposed on a bottom surface of the main body 10. The moving wheel 80 may be provided in plurality of on both sides of the main body 10.

Also, a side brush 90 for collecting foreign materials of a cleaning surface toward a suction part (see reference numeral 18 of FIG. 5) of the cleaner 1 during the cleaning is disposed on each of both sides of the main body 10. The side brush 90 may be rotatably coupled to the main body 10.

The main body 10 includes a suction motor 12 serving as a drive unit providing a suction force for sucking the foreign materials and an agitator drive unit 16 which drives a wheel drive unit 14 providing a driving force for rotating the moving wheel 80 and an agitator (see reference numeral 60 of FIG. 5) for dusting the dusts of the cleaning surface when the cleaning.

Also, a seat part 22 for seating the foreign material storage unit 100 is disposed on the first cover 20. The seat part 22 may be recessed downward form an upper portion of the first cover 20. The seat part 22 may have a size corresponding to that of the foreign material storage unit 100.

A first communication part 23 communicating with the foreign material storage unit 100 is disposed at a side of the seat part 22. At least one portion of the first cover 20 may be opened and inclined in one direction to form the first communication part 23.

The second cover 50 is rotatably coupled to a side of the first cover 20 to selectively shield the opened top surface of the first cover 20. The opened top surface is disposed above the seat part 22.

The first cover 20 may be called a "main cover" in that it 20 shields a side of the main body 10, and the second cover 20 may be called an "auxiliary cover" or "foreign material cover" in that it 20 is selectively opened to separate the foreign material storage unit 100.

A rotation lever 52 may be disposed on a side of the second cover 50 to rotate the second cover 50. The rotation lever 52 is rotatably inserted into the first cover 20.

Also, a hook protrusion 51 hooked on the first cover 20 is disposed on the second cover 50. The hook protrusion 51 may be disposed on an inner surface of the second cover 50. A hook 21 hooked with the hook protrusion 51 is disposed on the first cover 20. The hook 21 is disposed on a position corresponding to that of the hook protrusion 51 in a state where the second cover 50 is closed.

A push part 55 to be manipulated by a user to open the second cover 50 is disposed on an outer surface of the second cover 50. The push part 55 may be disposed on a side opposite to that of the hook protrusion 51.

When the push part 55 is pushed in a state where the second cover 50 is closed, the coupling between the hook protrusion 51 and the hook 21 may be released. Also, when the second cover 50 is closed in a state where the second cover 50 is opened, the hook protrusion 51 may be hooked on the hook 21.

That is, a hook structure between the hook protrusion and the hook 21 may have a structure in which the hook protrusion 51 and the hook 21 are hooked when pushed once and released when hooked again once. The hook structure may be the previously well-known technology which can be applied to a general cover, and thus, the detailed descriptions thereof will be omitted.

The foreign material storage unit 100 includes a storage unit main body 110 for defining a storage space of the foreign materials and a storage unit cover 120 for covering an upper side of the storage unit main body 110. A handle 122 to be grasped by the user may be disposed on the storage unit cover 120.

A second communication part 112 communicating with the first communication part 23 is disposed in the storage unit main body 110. At least one portion of the storage unit main body 110 may be opened and inclined in a direction corresponding to that of the first communication part 23 to form the second communication part 112.

Air sucked into the robot cleaner 1 may be introduced into the foreign material storage unit 100 through the first and second communication parts 23 and 112. Here, the second communication part 112 may be called an "air inlet" of the foreign material storage unit 100, and the first communication part 23 may be called a "cover communication part".

In a state where the foreign material storage unit 100 is seated on the seat part 22, the second communication part 112 may contact a side of the first communication part 23. Here, the second communication part 112 may have a size corresponding to that of the first communication part 23.

When the foreign material storage unit 100 is seated on the first cover 20 and the suction motor 12 is driven, the first and second communication parts 23 and 112 may communicate with each other. However, when the operation of the suction motor 12 is stopped, the communication between the first and second communication parts 23 and 112 may be interrupted. The related description will now be described with reference to drawings.

Figure 3:
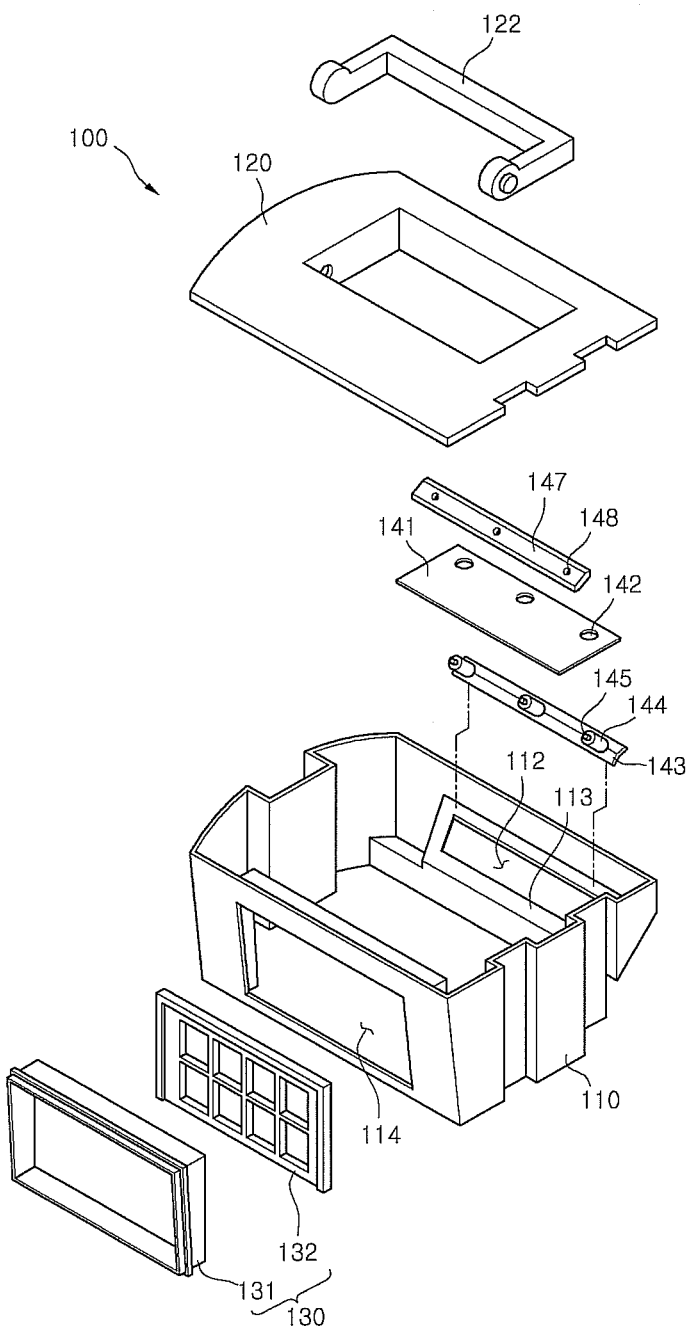
FIG. 3 is an exploded perspective view of a foreign material storage unit according to the first embodiment.
Figure 4:
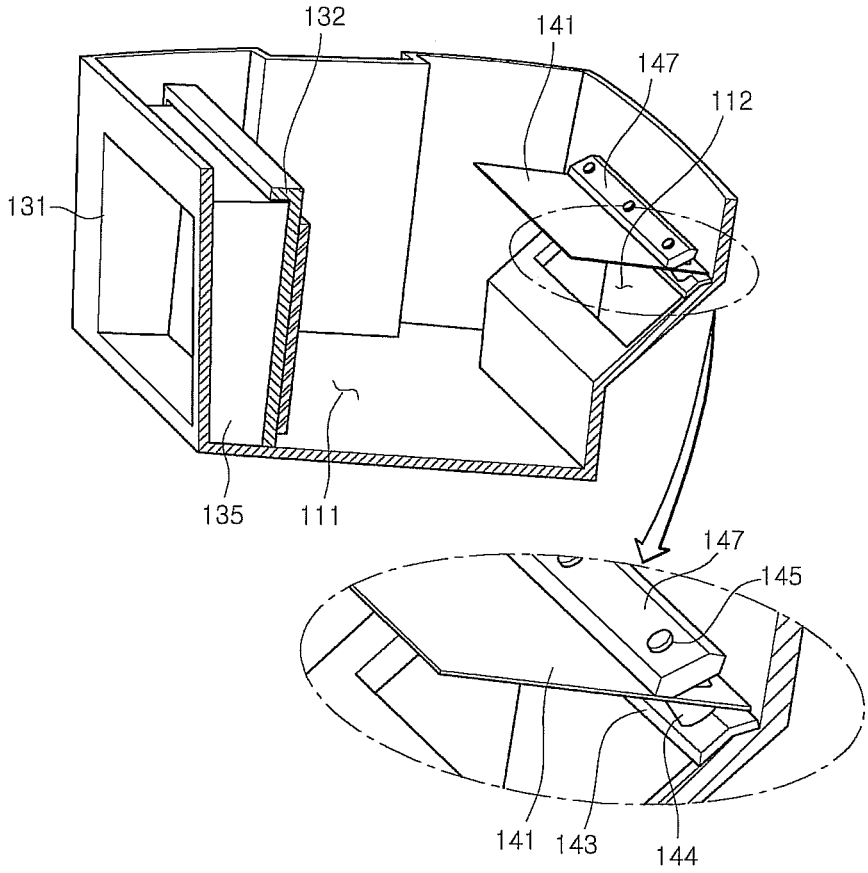
FIG. 4 is a sectional view of the foreign material storage unit according to the first embodiment.

FIG. 3 is an exploded perspective view of a foreign material storage unit according to the first embodiment. FIG. 4 is an exploded perspective view of a foreign material storage unit according to the first embodiment.

Referring to FIGS. 3 and 4, the foreign material storage unit 100 according to the first embodiment includes a storage unit main body 110 for defining a foreign material storage space 111 and a storage unit cover 120 for shielding an opened top surface of the storage unit main body 110.

The second communication part 112 communicating with the first communication part 23 is disposed at a side of the storage unit main body 110. Also, a motor-side opening 114 opened toward a side of the suction motor 12 is defined in the other side of the storage unit main body 110.

Also, a shield member 141 for selectively shielding the second communication part 112 is disposed inside the storage unit main body 110. The shield member 141 may be rotatably coupled to a side of the second communication part 112.

A support surface 113 for supporting the shield member 141 is disposed on a circumference of the second communication part 112. The shield member 141 may shield the second communication part 112 in a state where it 141 is supported by the support surface 113. The shield member 141 may have a size corresponding to the sum of those of the second communication part 112 and the support surface 113.

A coupling member 143 for coupling the shield member 141 to a side of the second communication part 112 is disposed on the storage unit main body 110. The coupling member 143 may be fixed to an upper side of the second communication part 112. However, the fixed position of the coupling member 143 is not limited thereto. For example, the coupling member 143 may be fixed to a left or right side or a lower side of the second communication part 112.

Also, a first coupling part 144 inserting the shield member 141 therein is inserted is disposed on the coupling member 143. The first coupling part 144 may protrude from one surface of the coupling member 143 toward an inside of the storage unit main body 110. The first coupling part 144 may be provided in at least one or more.

A first insertion hole 142 in which the first coupling part 144 is inserted is defined in the shield member 141. The first insertion hole 142 may be provided in size and number corresponding to those of the first coupling part 144.

An interference member 147 interfering with an upper portion of the shield member 141 when the shield member 141 is moved is disposed on a side of the shield member 141. A second insertion hole 148 coupled to the coupling member 143 is defined in the interference member 147. The second insertion hole 148 may have a size slightly less than that of the first insertion hole 142.

Also, a second coupling part 145 inserted into the second insertion hole 148 is inserted is disposed on the coupling member 143. The second coupling part 145 may extend upward from the first coupling part 144. Also, the second coupling part 145 may have a size slightly less than that of the first coupling part 144.

That is, the shield member 141 is inserted outside the first coupling part 144, and the interference member 147 is inserted outside the second coupling part 145. Thus, the shield member 141 may be rotated with respect to a center of the first coupling part 144. Also, since the upper portion of the shield member 141 interferes with the interference member 147, it may prevent the shield member 141 from being separated from the coupling member 143.

When the suction motor 12 is operated, since a suction force is applied inward from the outside of the foreign material storage unit 100, the shield member 141 may be rotated in a direction in which the second communication part 112 is opened. On the other hand, when the operation of the suction motor 12 is stopped, since the suction force is not applied, the shield member 141 may be rotated in a direction in which the second communication part 112 is closed.

As described above, since the shield member 141 is closed when the suction motor 12 is not driven, the foreign materials within the storage space 111 do not flow backward to the outside. When the user separates the foreign material storage unit 100, the foreign materials may not be discharged to the outside.

A filter 135 for filtering the foreign materials sucked into the storage space 111 and first and second fixing parts 131 and 132 for fixing the filter 135 to the motor-side opening 114 are disposed in the motor-side opening 114.

The first and second fixing parts 131 and 132 may be disposed on one side and the other side of the filter 135, respectively. The foreign materials contained in the air sucked into the storage space 111 may be filtered, and the filtered air may pass through the motor-side opening 114 to flow into the suction motor 12.

Figure 5:
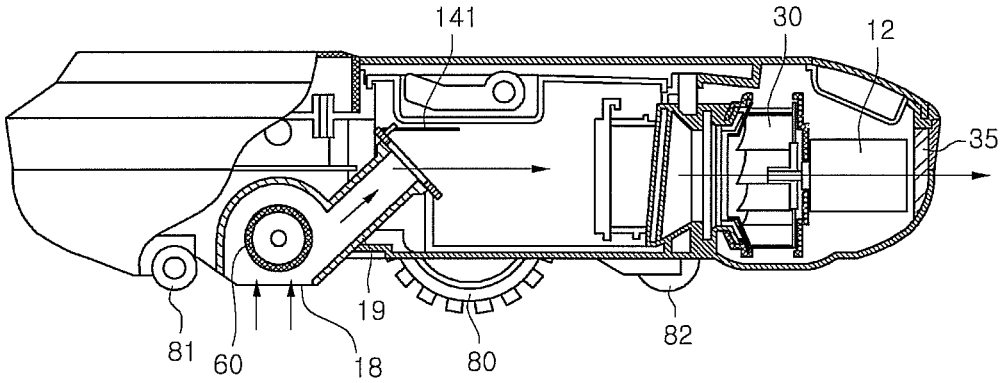
FIG. 5 is a sectional view taken along line I-I' of FIG. 1.

FIG. 5 is a sectional view taken along line I-I' of FIG. 1.

Referring to FIG. 5, the robot cleaner 1 according to the first embodiment includes a suction part 18 for sucking foreign materials from the cleaning surface, the agitator 60 rotatably disposed above the suction part 18, and a connection pipe 19 extending from the suction part 18 toward the foreign material storage unit 100. The connection pipe 19 may be inclinedly disposed from the suction part 18 toward a rear upper side of the suction part 18.

A suction motor 12 for providing a suction force and a blower 30 are disposed at a rear side of the foreign material storage unit 100. The blower 30 may be disposed on at a front side of the suction motor 12.

An exhaust filter 35 for filtering fine foreign materials contained in the air passing through the suction motor 12 is disposed at a rear side of the suction motor 12. A first auxiliary wheel 81 and a second auxiliary wheel 82 for easily moving the robot cleaner 1 may be disposed at front and rear sides of the moving wheel 80, respectively.

An airflow according to the current embodiment will be described below.

The air containing the foreign materials sucked through the suction part 18 may be introduced into the foreign material storage unit 100 via the connection pipe 19. The foreign materials contained in the introduced air may be filtered by the filter 135. Then, the filtered air may pass through the exhaust filter 35 via the suction motor 12. The air passing through the exhaust filter 35 may be exhausted to the outside of the robot cleaner 1.

As shown in FIG. 5, the air sucked through the suction part 18 may flow backward from the foreign material storage unit 100 to the exhaust filter 35 via the connection pipe 19. That is, the air may flow straightly without being turned from one direction to the other direction to minimize a flow loss, thereby improving suction performance.

Hereinafter, descriptions will be made according to a second embodiment. Since the current embodiment is the same as the first embodiment except for a detection unit, different parts between the first and second embodiments will be described principally, and descriptions of the same parts will be denoted by the same reference numerals and descriptions of the first embodiment.

Figure 6:
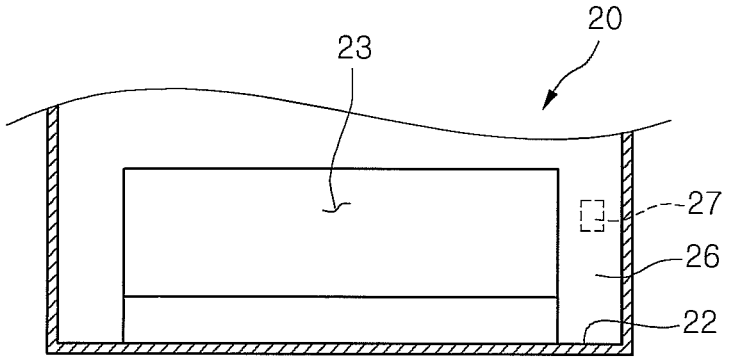
FIG. 6 is a sectional view taken along line II-II of FIG. 2 according to a second embodiment.
Figure 7:
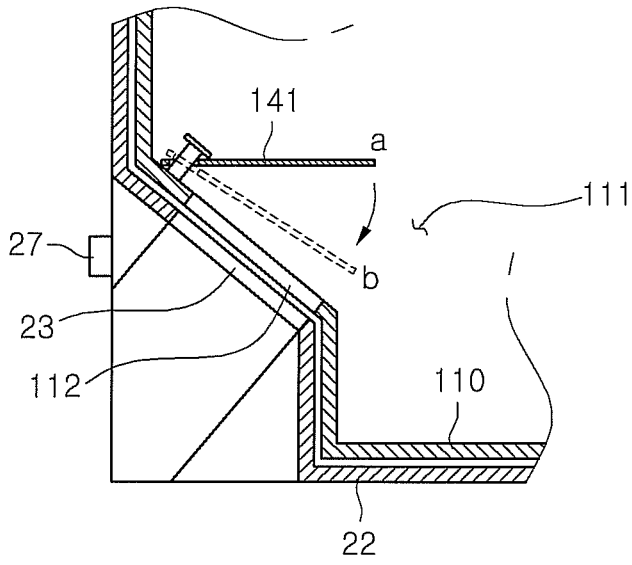
FIG. 7 is a sectional view of a robot cleaner according to the second embodiment.

FIG. 6 is a sectional view taken along line II-II of FIG. 2 according to a second embodiment. FIG. 7 is a sectional view of a robot cleaner according to the second embodiment.

Referring to FIGS. 6 and 7, a detection unit 27 for detecting a movement of a shield member 141 is disposed on a first cover 20 according to a second embodiment. The detection unit 27 may include an infrared sensor.

The detection unit 27 may be disposed on a side of a well 26 in which the first communication part 23 is defined. That is, the well 26 may be disposed along a circumference of the first communication part 23, and the detection unit 27 may be disposed on a side of the first communication part 23.

In a state where a foreign material storage unit 100 is seated on the seat part 22, the well 26 may correspond to a support surface 113 of the foreign material storage unit 100. That is, the detection unit 27 may be disposed at a position corresponding to a circumference of a shield member 141.

Thus, when the shield member 141 is rotated to shield at least one portion of the second communication part 112, the detection unit 27 may detect the shield member 141.

The well 26 may be formed of a transparent material to allow the detection unit 27 to easily detect the shield member 141. The shield member 141 may be formed of an opaque material. In this case, a signal transmitted from the detection unit 27 may pass through the well 26 and then be reflected by the shield member 141 to come back.

As shown in FIG. 7, when a suction motor 12 is operated and air is introduced into the foreign material storage unit 100, the shield member 141 may be disposed on a position "a" at which the shield member 141 is opened. In this case, the detection unit 27 does not detect the shield member 141.

When a filter 135 may be blocked by the foreign materials stored in a storage space 111, a suction force of the suction motor 12 may not be properly transmitted into the foreign material storage unit 100. That is, the suction force of the suction motor 12 may be deteriorated.

In this case, the shield member 141 may be rotated in a direction in which the second communication part is shielded.

In a state where the suction motor 12 is driven, when the shield member 141 is rotated in a direction "b" in which the shield member 141 shields the second communication part 112, the detection unit 27 detects the shield member 141.

Also, the signal detected by the detection unit 27 is transmitted into a control unit (not shown) of the robot cleaner 1. The control unit may recognize the blocking of the filter through the signal to inform an alarm to the outside through an alarming unit (not shown).

The alarming unit may include a display or an alarming lamp.

In the current embodiment, the detection unit 27 is disposed on the well 26. However, the detection unit 27 may be disposed on a predetermined position of a main body 10 corresponding to that of the well 26.

Hereinafter, descriptions will be made according to a third embodiment. Since the current embodiment is the same as the first embodiment except for a rotation lever, different parts between the first and third embodiments will be described principally, and descriptions of the same parts will be denoted by the same reference numerals and descriptions of the first and second embodiments.

Figure 8:
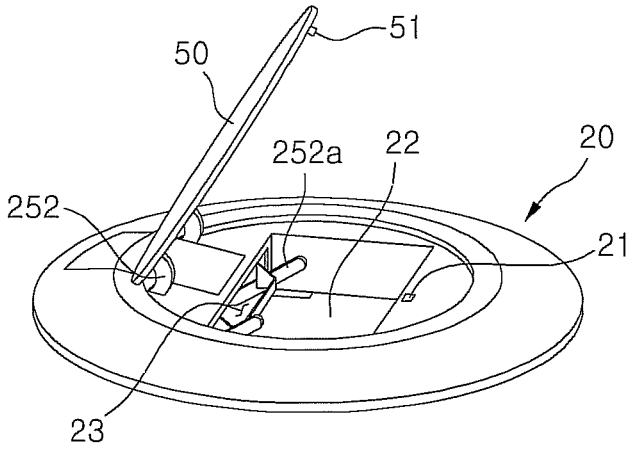
FIG. 8 is a perspective view illustrating a cover of a robot cleaner according to a third embodiment.
Figure 9:
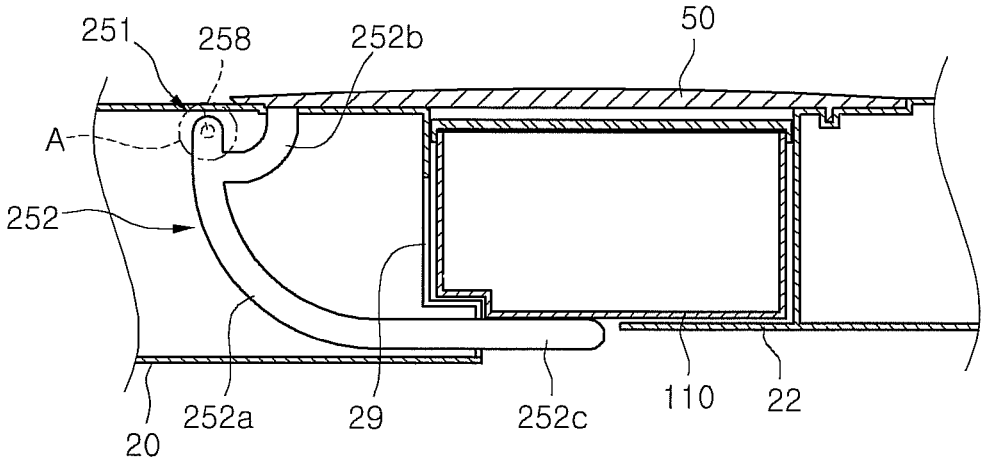
FIG. 9 is a sectional view of the robot cleaner according to the third embodiment.
Figure 10:
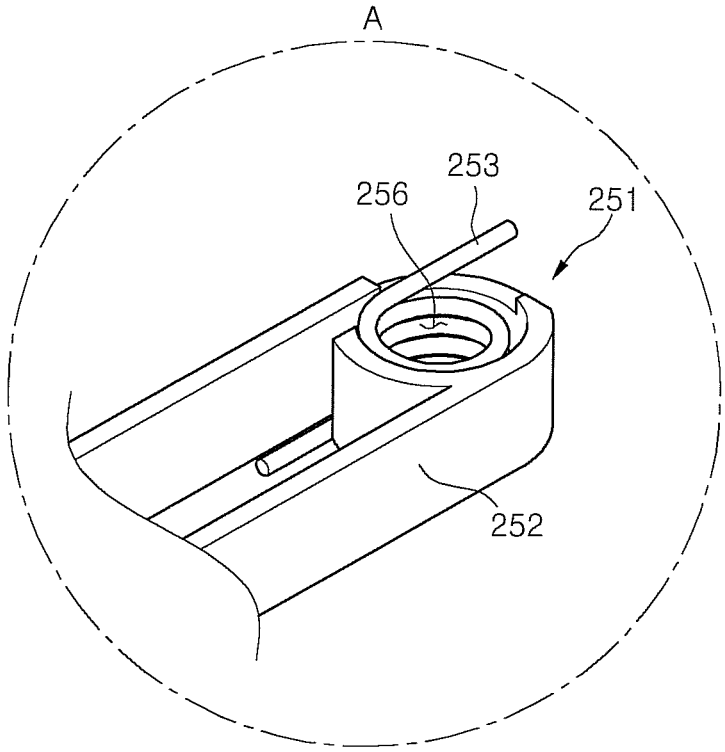
FIG. 10 is a view illustrating a portion "A" of FIG. 9.
Figure 11:
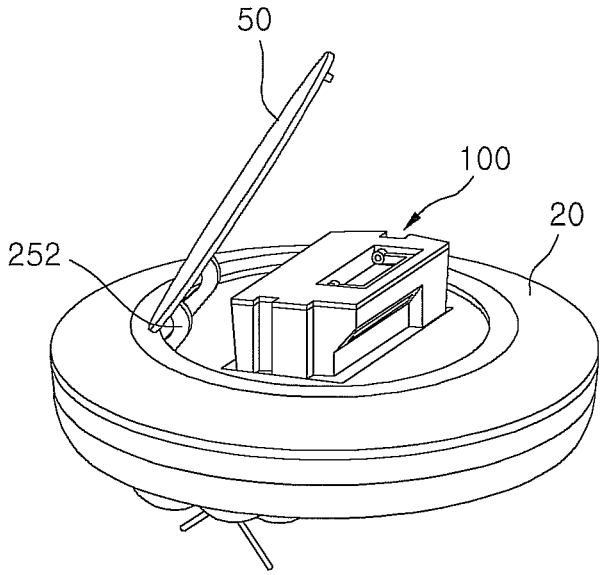
FIG. 11 is a view illustrating a rising state of a foreign material storage unit according to the third embodiment.

FIG. 8 is a perspective view illustrating a cover of a robot cleaner according to a third embodiment. FIG. 9 is a sectional view of the robot cleaner according to the third embodiment. FIG. 10 is a view illustrating a portion "A" of FIG. 9. FIG. 11 is a view illustrating a rising state of a foreign material storage unit according to the third embodiment.

Referring to FIGS. 8 to 11, a second cover 50 according to a third embodiment include a hinge part 251 for rotating the second cover 50 and a rotation lever 252 connecting the second cover 50 and the hinge part 251 and extending from the hinge part 251 in one direction.

In detail, the hinge part 251 includes a rotation shaft 258 providing a rotation center of the second cover 50, a rotation shaft insertion part 256 disposed on the rotation lever 252 and in which the rotation shaft 258 is inserted, and an elastic member 253 disposed on the rotation shaft insertion part 256 to provide a restoring force to the rotation lever 252.

The rotation shaft 258 may be disposed within a first cover 20 and inserted into the rotation shaft insertion part 256. Thus, the rotation shaft 258 may be coupled to the rotation lever 252.

The elastic member 253 may be disposed along an inner circumference of the rotation shaft insertion part 256 to surround the outside of the rotation shaft 258. The elastic member 253 may provide a restoring force in a direction in which the second cover 50 is opened. The elastic member 253 may include a torsion spring.

When a hook protrusion 51 is hooked on a hook 21 to couple the second cover 50 to the first cover 20, the second cover 50 may overcome the restoring force of the elastic member 253 to maintain the closed state.

On the other hand, when the hooked state between the hook protrusion 51 and the hook 21 is released, the second cover 50 may be rotated in a direction in which the second cover 50 is opened by the restoring force of the elastic member 253.

Also, the rotation lever 252 includes a lever main body 252*a* extending from a hinge part 251 toward the foreign material storage unit 100, a rotation connection part 252*b* connecting the second cover 50 to the lever main body 252*a*, and a lever end 252*c* defining at least one portion of the lever main body 252*a* and disposed under the foreign material storage unit 100. Here, the rotation lever 252 may be disposed on both sides of the second cover 50.

The lever main body 252*a* may extend from the hinge part 251 toward a lower side of the foreign material storage unit 100 in a round shape. The rotation connection part 252*b* may extend from the second cover 50 toward the lever main body 252*a* in a round shape. Also, the lever main body 252*a* and the rotation connection part 252*b* may be integrally rotated with respect to a center of the hinge part 251.

When the lever main body 252*a* is rotated, the lever end 252*c* may compress a bottom surface of the foreign material storage unit 100. That is, a portion of the seat part 22 described in the first embodiment on which the lever end 252*c* is disposed may be vertically opened.

A rotation opening 29 through which the lever main body 252*a* passes is defined in the first cover 20. The rotation opening 29 may be defined in the well (see reference numeral 26 of FIG. 6). The rotation lever 252 passes through the well 26 to extend to the lower side of the foreign material storage unit 100.

The rotation opening 29 may have a predetermined size in a height direction thereof. Also, the rotation opening 29 may have a size corresponding to a rotation range of the rotation lever 252. Thus, the rotation lever 252 may be rotated in a predetermined direction in a state where the rotation lever 252 is inserted into the rotation opening 29.

Hereinafter, operations of the second cover 50 and the foreign material storage unit 100 according to the current embodiment will be described.

When the hooked state between the second cover 50 and the first cover 20 is released, the second cover 50 may be rotated in a direction in which the second cover 50 is opened by the restoring force of the elastic member 253.

In this process, the rotation lever 252 is rotated in a counter clockwise direction (when viewed in FIG. 9) with respect to a center of the hinge part 251. Thus, the lever end 252*c* may compress the bottom surface of the foreign material storage unit 100 upwardly.

Thus, the foreign material storage unit 100 may be lifted upward up to a position greater than that of a top surface of the first cover 20. In this state, the user may separate the foreign material storage unit 100.

As described above, since the foreign material storage unit 100 is lifted upward when the second cover 50 is opened, the user may easily separate the foreign material storage unit 100 from the first cover 20 by grasping the foreign material storage unit 100.

According to the embodiments, since the foreign material storage unit is opened only when the suction motor of the cleaner is operated to introduce air therein, the dusts within the foreign material storage unit do not flow backward when the suction motor is not operated.

Also, since the blocking of the filter within the foreign material storage unit may be detected by the detection unit, the filter or the foreign material storage unit may be cleaned at the appropriate time by the user.

Also, since the foreign material storage unit may be easily cleaned at the appropriate time, it may prevent the suction performance of the cleaner from being deteriorated.

Also, when the cover of the cleaner is opened to separate the foreign material storage unit, since the foreign material storage unit may be moved above the main body, the user may easily separate the foreign material storage unit.

Also, user's accessibility with respect to the foreign material storage unit may be improved to improve convenience of use.

In the embodiments, the foreign material storage unit can be selectively opened according to whether the cleaner is operated to detect the blocking of the filter of the foreign material storage unit. Also, since the foreign material storage unit can be easily separated according to the opening of the cover of the cleaner, the industrial applicability may be significantly high.

What is claimed is:

1. A robot cleaner comprising:

a main body comprising a drive unit for providing a suction force;

a main cover to shield a side of the main body;

a foreign material storage unit separably disposed on the main cover, the foreign material storage unit having an air inlet for introducing air containing foreign materials;

a foreign material cover disposed on the main cover, the foreign material cover selectively shielding a side of the foreign material storage unit;

a shield member disposed on the foreign material storage unit, the shield member selectively shielding the air inlet, a detection unit disposed on the main cover or main body to detect whether the shield member is operated.

2. The robot cleaner according to claim 1, further comprising: a coupling member that couples the shield member to the foreign material storage unit; and an interference member interfering with a side of the shield member.

3. The robot cleaner according to claim 2, wherein the coupling member comprises:

a first coupling part coupled to the shield member; and a second coupling part coupled to the interference member.

4. The robot cleaner according to claim 1, wherein the shield member is rotatably coupled to at least one side of the air inlet.

5. The robot cleaner according to claim 1, wherein the shield member is rotated in a direction in which the air inlet is opened by an operation of the drive unit.

6. The robot cleaner according to claim 1, wherein the main cover comprises:

a seat part on which the foreign material storage unit is seated; and a cover communication part defined by opening a side of the seat part, the cover communication part communicating with the air inlet.

7. The robot cleaner according to claim 1, further comprising:

a rotation lever configured to rotatably couple the foreign material cover to the main cover; and a hinge part disposed at a rotation center of the rotation lever.

8. The robot cleaner according to claim 7, wherein the rotation lever comprises: a lever main body extending from the hinge part; and a lever end defining at least one portion of the lever main body, the lever end being disposed under the foreign material storage unit.

9. The robot cleaner according to claim 7, wherein the rotation lever compresses a side of the foreign material storage unit when the foreign material storage unit is opened.

10. New A robot cleaner comprising:

a main body comprising a drive unit for providing a suction force;

a main cover to shield a side of the main body;

a foreign material storage unit separably disposed on the main cover, the foreign material storage unit having an air inlet for introducing air containing foreign materials;

a foreign material cover disposed on the main cover, the foreign material cover selectively shielding a side of the foreign material storage unit;

a shield member disposed on the foreign material storage unit, the shield member selectively shielding the air inlet;

a coupling member to couple the shield member to the foreign material storage unit; and an interference member to interfere with a side of the shield member.

11. A robot cleaner comprising:

a main body comprising a drive unit for providing a suction force;

a main cover to shield a side of the main body;

a foreign material storage unit separably disposed on the main cover, the foreign material storage unit having an air inlet for introducing air containing foreign materials;

a foreign material cover disposed on the main cover, the foreign material cover selectively shielding a side of the foreign material storage unit;

a shield member disposed on the foreign material storage unit, the shield member selectively shielding the air inlet;

a rotation lever to rotatably couple the foreign material cover to the main cover; and a hinge part disposed at a rotation center of the rotation lever, wherein the rotation lever comprises:

a lever main body extending from the hinge part; and a lever end defining at least one portion of the lever main body, the lever end being disposed under the foreign material storage unit.

* * * * *